US012351956B2

(12) United States Patent
Ikenaga

(10) Patent No.: US 12,351,956 B2
(45) Date of Patent: Jul. 8, 2025

(54) COVERING MATERIAL INCLUDING THREE-DIMENSIONAL KNITTED MATERIAL

(71) Applicant: Asahi Kasei Kabushiki Kaisha, Tokyo (JP)

(72) Inventor: Hideo Ikenaga, Tokyo (JP)

(73) Assignee: Asahi Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 18/682,472

(22) PCT Filed: Sep. 30, 2022

(86) PCT No.: PCT/JP2022/036779
§ 371 (c)(1),
(2) Date: Feb. 9, 2024

(87) PCT Pub. No.: WO2023/058578
PCT Pub. Date: Apr. 13, 2023

(65) Prior Publication Data

US 2025/0137175 A1 May 1, 2025

(30) Foreign Application Priority Data

Oct. 4, 2021 (JP) ..... 2021-163467

(51) Int. Cl.
*D04B 21/12* (2006.01)
*D04B 21/16* (2006.01)

(52) U.S. Cl.
CPC ..... *D04B 21/12* (2013.01); *D04B 21/16* (2013.01); *D10B 2331/04* (2013.01);
(Continued)

(58) Field of Classification Search
CPC ..... D04B 21/12; D04B 21/16; D04B 21/06; D04B 21/08; D04B 21/18; D04B 25/10
See application file for complete search history.

(56) References Cited

U.S. PATENT DOCUMENTS 4,787,219 A * 11/1988 Sato ..... B29D 99/0003 66/196
6,477,865 B1 * 11/2002 Matsumoto ..... D04B 21/10 66/196

(Continued)

FOREIGN PATENT DOCUMENTS

CZ 290087 B6 * 5/2002 ..... C03B 23/023
EP 4414489 A1 * 8/2024 ..... D02G 3/04

(Continued)

OTHER PUBLICATIONS

International Search Report issued in corresponding International Patent Application No. PCT/JP2022/036779 dated Dec. 13, 2022.

(Continued)

*Primary Examiner* — Danny Worrell
(74) *Attorney, Agent, or Firm* — Morgan, Lewis & Bockius LLP

(57) ABSTRACT

A covering material according to the present disclosure comprises a three-dimensional knitted material that is constituted by a surface layer knitted fabric, a back layer knitted fabric, and a connecting yarn which connects the surface layer knitted fabric and the back layer knitted fabric, said covering material being characterized in that: not less than 30% of stitches included in the surface layer knitted fabric are formed from a composite yarn that includes two or more differing types of colored yarn; and in the not less than 30% of stitches that are formed by the composite yarn, a stich formed by the composite yarn and a stitch adjacent thereto in the course direction and/or wale direction form an angle of 20-80 degrees.

18 Claims, 2 Drawing Sheets

(52) U.S. Cl.
CPC ..... *D10B 2403/0114* (2013.01); *D10B 2403/0213* (2013.01); *D10B 2505/08* (2013.01)

(56) References Cited

U.S. PATENT DOCUMENTS

| | | | | |
|---|---|---|---|---|
| 7,611,999 | B2 * | 11/2009 | McMurray | D04B 1/126 66/196 |
| 2002/0157429 | A1 | 10/2002 | Matsumoto | |
| 2003/0101776 | A1 * | 6/2003 | Shirasaki | D04B 21/12 66/196 |
| 2004/0097151 | A1 | 5/2004 | McMurray | |
| 2010/0304632 | A1 | 12/2010 | De Meulemeester | |
| 2021/0130993 | A1 * | 5/2021 | Mizukami | D04B 21/10 |

FOREIGN PATENT DOCUMENTS

| | | | |
|---|---|---|---|
| JP | S46-009848 | B | 3/1971 |
| JP | S49-072412 | A | 7/1974 |
| JP | S49-126943 | A | 12/1974 |
| JP | S51-099145 | A | 9/1976 |
| JP | 2003-049348 | A | 2/2003 |
| JP | 2004-107800 | A | 4/2004 |
| JP | 2004-229894 | A | 8/2004 |
| JP | 2007-195777 | A | 8/2007 |
| JP | 2008-069498 | A | 3/2008 |
| JP | 2009-262407 | A | 11/2009 |
| JP | 2013-064216 | A | 4/2013 |
| JP | 2014-088632 | A | 5/2014 |
| JP | 2023054536 | A * | 4/2023 |
| WO | 2018/235738 | A1 | 12/2018 |

OTHER PUBLICATIONS

International Preliminary Report on Patentability and Written Opinion issued in corresponding International Patent Application No. PCT/JP2022/036779 dated Apr. 18, 2024.

Supplementary European Search Report issued in European Patent Application No. 22878447.6 dated Jan. 30, 2025.

* cited by examiner

COVERING MATERIAL INCLUDING THREE-DIMENSIONAL KNITTED MATERIAL

FIELD

The present invention relates to a covering material.

BACKGROUND

Conventionally, three-dimensional knitted materials constituted by knitted fabrics of two front and back layers and a connecting yarn which connects the knitted fabrics of the two layers have cushioning properties in the thickness direction due to the use of a monofilament as the connecting yarn, which ensures high breathability with the mesh configuration of the knitted fabrics on the front and back sides, and thus, they are widely used as a cushioning material which is cool and which has high moisture prevention properties in applications such as seats and bedding.

When using a three-dimensional knitted material as a covering material for seats of vehicles and furniture, interior materials of vehicles, etc., since designability is required of the knitted fabric of the front layer of three-dimensional knitted material, achieving a high degree of designability by imparting the knitted fabric of the front layer with a pattern by needle selection and/or a pattern by changing the colored yarns has been proposed.

For example, Patent Literature 1 below discloses a three-dimensional weft knitted fabric having excellent design, in which weft knitted fabrics of two front and back layers are connected by a monofilament yarn, wherein at least one knitted fabric surface of the front and back knitted fabrics has a pattern created changing by needle selection and/or a pattern created by changing the color yarns.

CITATION LIST

Patent Literature

[PTL 1] Japanese Unexamined Patent Publication (Kokai) No. 2004-107800

SUMMARY

Technical Problem

However, though the knitted fabric surface of the three-dimensional weft knitted material of Patent Literature 1 is imparted with designability by changing the colored yarns by needle selection or changing the pattern, since the individual stitches are large, the color changes are excessively obvious from stitch to stitch, whereby it is difficult to impart natural heather designability.

In light of the circumstances of the prior art described above, an object of the present invention is to provide a covering material for seats for vehicles and furniture, and interior materials for vehicles which can solve the above problems of the prior art, wherein by weaving a composite yarn containing two or more different colored yarns into the front layer knitted fabric of a three-dimensional knitted material, and allowing the stitches formed of the composite yarn and the stitches adjacent thereto in the course direction and/or the wale direction to form a predetermined angle, a high designability with a natural heather can be achieved.

Solution to Problem

As a result of rigorous investigation in order to solve the problems described above, the present inventors have unexpectedly discovered that the above problems can be solved by a covering material comprising a three-dimensional knitted material constituted by a front layer knitted fabric, a back layer knitted fabric, and a connecting yarn which connects the front layer knitted fabric and the back layer knitted fabric, wherein 30% or more of stitches included in the front layer knitted fabric are formed of a composite yarn containing two or more different colored yarns, and 30% or more of the stitches formed of the composite yarn are each arranged at an incline so as to form a predetermined angle with a stitch adjacent thereto in the course direction and/or the wale direction, and have completed the present invention.

Specifically, the present invention is as described below.

[1]A covering material, comprising a three-dimensional knitted material constituted by a front layer knitted fabric, a back layer knitted fabric, and a connecting yarn which connects the front layer knitted fabric and the back layer knitted fabric, wherein 30% or more of stitches included in the front layer knitted fabric are formed of a composite yarn containing two or more different colored yarns, and 30% or more of the stitches formed of the composite yarn each form an angle of 20 degrees or more and 80 degrees or less with a stitch adjacent thereto in a course direction and/or a wale direction.

[2] The covering material according to [1], wherein 50% or more of stitches included in the front layer knitted fabric are formed of a composite yarn containing two or more different colored yarns.

[3] The covering material according to [2], wherein 60% or more of stitches included in the front layer knitted fabric are formed of a composite yarn containing two or more different colored yarns.

[4] The covering material according to any one of [1] to [3], wherein 50% or more of the stitches formed of the composite yarn each have an angle of 20 degrees or more and 80 degrees or less with a stitch adjacent thereto in the course direction and/or the wale direction.

[5] The covering material according to any one of [1] to [4], wherein the three-dimensional knitted material has openings of 0.3 mm or more and 2.5 mm or less, and 30% or more of stitches formed of the composite yarn face the openings of 0.3 mm or more and 2.5 mm or less.

[6] The covering material according to [5], wherein 50% or more of stitches formed of the composite yarn face the openings of 0.3 mm or more and 2.5 mm or less.

[7] The covering material according to [5] or [6], wherein the back layer knitted fabric contains a yarn which is darker than at least one of the colored yarns of the composite yarn of the front layer knitted fabric.

[8] The covering material according to any one of [1] to [7], wherein 30% or more of stitches formed of the composite yarn are each adjacent in the course direction and/or wale direction to a stitch formed of a colored yarn different from at least one of the colored yarns of the composite yarn.

[9] The covering material according to any one of [1] to [8], wherein in the front layer knitted fabric, a fineness of the composite yarn is 150 decitex or more and 800 decitex or less.

[10] The covering material according to any one of [1] to [9], wherein a knitting density of the front layer knitted fabric is 20 courses/2.54 cm or more and 43 courses/2.54 cm or less and 18 wales/2.54 cm or more and 34 wales/2.54 cm or less.

Advantageous Effects of Invention

The covering material comprising a three-dimensional knitted material of the present invention has a composite yarn containing two or more different colored yarns is knitted into a front layer knitted fabric of the three-dimensional knitted material and is imparted with a predetermined angle between stitches formed of the composite yarn and stitches adjacent thereto in the course direction and/or wale direction, and thus exhibits high designability with a natural heather.

DESCRIPTION OF EMBODIMENTS

Figure 1:
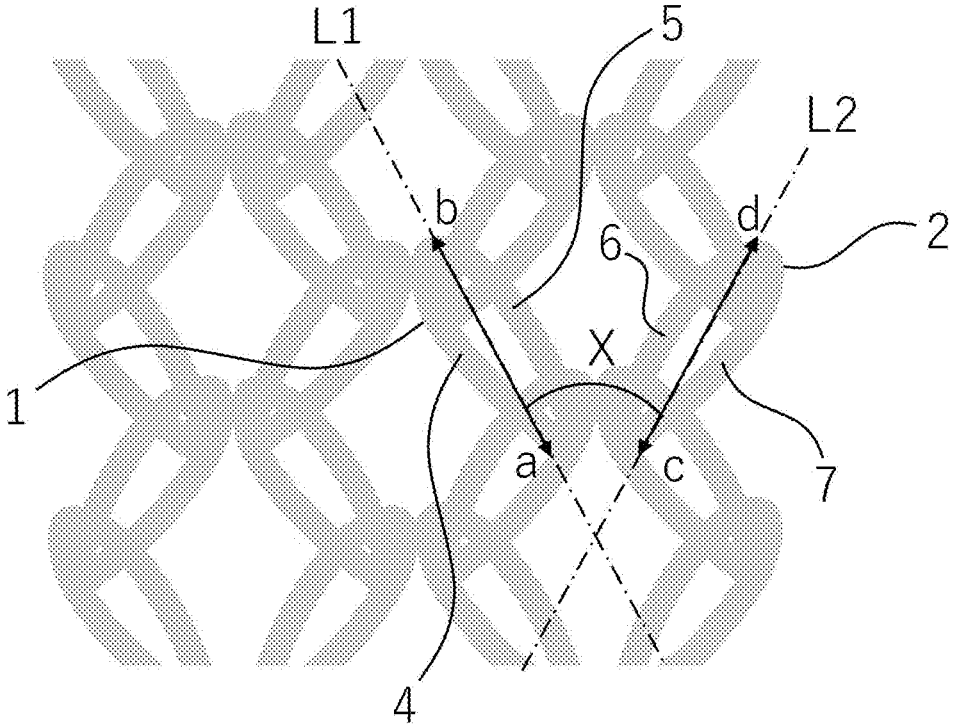
FIG. 1 is a schematic view of an example of the present embodiment, in which a stitch of a front layer knitted fabric formed of a composite yarn and a stitch adjacent thereto in the course direction form an angle.

The embodiments of the present invention will be described in detail below.

The covering material according to an embodiment (referred to as the present embodiment) of the present invention comprises a three-dimensional knitted material constituted by a front layer knitted fabric, a back layer knitted fabric, and a connecting yarn which connects the front layer knitted fabric and the back layer knitted fabric, wherein 30% or more of stitches included in the front layer knitted fabric are formed of a composite yarn containing two or more different colored yarns, and 30% or more of the stitches formed of the composite yarn each form an angle of 20 degrees or more and 80 degrees or less with a stitch adjacent thereto in the course direction and/or the wale direction.

The covering material of the present embodiment comprises a three-dimensional knitted material constituted by a front layer knitted fabric, a back layer knitted fabric, and a connecting yarn which connects the two layers of knitted fabrics. The three-dimensional knitted material is knitted by a double raschel warp knitting machine or a double circular knitting machine, and the gauge of the knitting machine is preferably 18 to 32.

In the three-dimensional knitted material constituting the covering material of the present embodiment, 30% or more of the stitches included in the front layer knitted fabric are formed of a composite yarn containing two or more different colored yarns. In the present embodiment, the phrase "composite yarn containing two or more different colored yarns" refers to a yarn which is made by combining two or more yarns having different color properties such as hue, saturation, brightness, and luster through a process such as twisting, interlacing, air jet processing, and composite false twisting. Though the phrase "two or more different colored yarns" described above refers to pre-colored yarns such as dope-dyed yarns and pre-dyed yarns, the two or more yarns may be yarns which become colored yarns via a dyeing process after knitting of the gray fabric of the three-dimensional knitted material. In order to suppress variations in the properties of the three-dimensional knitted material due to the dyeing process, it is more preferable that the two or more different colored yarns be dope-dyed yarns or pre-dyed yarns, and it is further preferable that they be dope-dyed yarns, which can eliminate the need for a dyeing process. Note that the phrase "colored yarns" includes uncolored white yarns.

The sentence "30% or more of the stitches included in the front layer knitted fabric are formed of a composite yarn containing two or more different colored yarns" means that 30% or more of the total stitches included in a predetermined area of the front layer knitted fabric are stitches formed of the composite yarn. The ratio of the stitches formed of the composite yarn is calculated by a method for calculating the ratio of the number of stitches formed of the composite yarn to the total stitch number in a predetermined area (for example, a 1 cm square) of an arbitrary portion of the front layer knitted fabric as viewed from the surface side.

Since 30% or more of the stitches included in the front layer knitted fabric are formed of a composite yarn containing two or more different colored yarns, the front layer knitted fabric is imparted with a natural heather. The ratio of the stitches formed of the composite yarn is more preferably 50% or more, and further preferably 60% or more.

In the three-dimensional knitted material constituting the covering material of the present embodiment, 30% or more of the stitches formed of the composite yarn containing two or more different colored yarns of the front layer knitted fabric each form an angle of 20 degrees or more and 80 degrees or less with a stitch adjacent thereto in the course direction and/or the wale direction. The ratio of the stitches is more preferably 50% or more, and further preferably 60% or more.

The ratio of the stitches formed of the composite yarn containing two or more different colored yarns and forming an angle is calculated by a method for calculating the ratio of the number of stitches of the composite yarn forming an angle of 20 degrees or more and 80 degrees or less with adjacent stitches relative to the total stitch number of the composite yarn in a predetermined area (for example, a 1 cm square) of an arbitrary portion of the front layer knitted fabric as viewed from the surface side.

It is preferable that 30% or more of the stitches formed of the composite yarn containing two or more different colored yarns each form an angle of 20 degrees or more and 80 degrees or less because the stitches formed of the composite yarn, without aligning excessively linearly in the course direction and/or the wale direction, exhibit a more natural heather, and at the same time, impart a marbled heather pattern with colors flowing diagonally, increasing designability. The angle is more preferably 30 degrees or more and 70 degrees or less.

Figure 2:
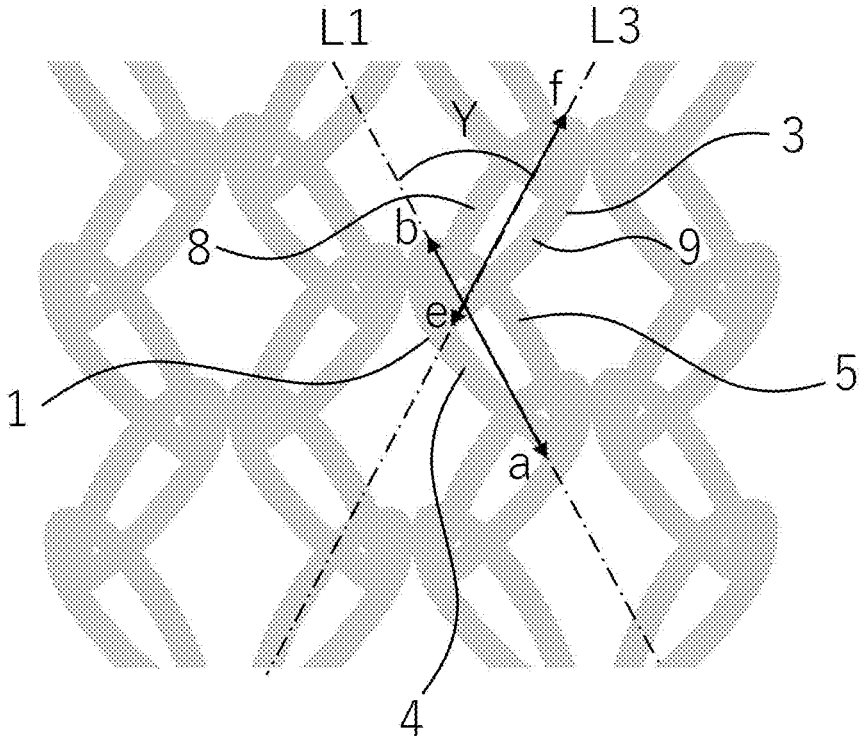
FIG. 2 is a schematic view of an example of the present embodiment, in which a stitch of a front layer knitted fabric formed of a composite yarn and a stitch adjacent thereto in the wale direction form an angle.

Regarding the angle formed between a stitch formed of a composite yarn containing two or more different colored yarns and a stitch adjacent thereto, FIG. 1 shows a schematic view of a state in which stitches adjacent to each other in the course direction (horizontal direction) form an angle of X degrees, and FIG. 2 shows a schematic view of a state in which stitches adjacent to each other in the wale direction (vertical direction) form an angle of Y degrees.

In FIG. 1, when viewed from the front side of front layer knitted fabric with the knitting start direction facing downwards, there are two pillars (4, 5) consisting of left and right fiber bundles of one stitch 1 formed of the composite yarn containing two or more different colored yarns, the pillar (4) thereof on one side includes the part located on the outermost surface side, and a straight line L1 is drawn to connect the lowest point (a) where the pillar can be seen to the highest point (b) where the pillar can be seen. There are two pillars (6, 7) consisting of left and right fiber bundles of stitch 2 adjacent to stitch 1 in the course direction (horizontal direction), the pillar (7) thereof on one side includes the part located on the outermost surface side, and a straight line L2 is drawn to connect the lowest point (c) where the pillar can be seen to the highest point (d) where the pillar can be seen. The angle formed by the intersection of the obtained straight lines L1 and L2 in the portion open in the direction of the end of knitting is defined as X degrees.

In FIG. 2, there are two pillars (8, 9) consisting of left and right fiber bundles of stitch 3 adjacent in the wale direction (vertical direction) to one stitch 1 formed of the composite yarn containing two or more different colored yarns, the pillar (9) thereof on one side includes the part on the outermost side, and a straight line L3 is drawn to connect the lowest point (e) where the pillar can be seen to the highest point (f) where the pillar can be seen. The angle formed by the intersection of the obtained straight lines L1 and L3 in the portion open in the direction of the end of knitting is defined as Y degrees.

Though the stitch adjacent to the one stitch formed of the composite yarn containing two or more different colored yarns may be formed of the same composite yarn as the composite yarn or may be formed of a colored yarn different from the composite yarn, it is more preferable that the adjacent stitch be formed of a colored yarn different from at least one of the colored yarns of the composite yarn because of a more natural heather or a heather with a geometric pattern, depending on the knitting structure.

In the three-dimensional knitted material constituting the covering material of the present embodiment, it is preferable that 30% or more of the stitches of the front layer knitted fabric formed of the composite yarn containing two or more different colored yarns face openings of 0.3 mm or more and 2.5 mm or less, because the appearance of the front layer knitted fabric is imparted with a more three-dimensional heather. In the present embodiment, the term "openings" refers to voids obtained by forming a gap of 0.3 mm or more in the course direction (horizontal direction) between adjacent stitch rows in some or all courses in vertical stitch rows forming the front layer knitted fabric, even if a pattern yarn is inlay knitted to fill the gap. The ratio of stitches formed of the composite yarn containing two or more different colored yarns facing openings of 0.3 mm or more and 2.5 mm or less is more preferably 40% or more, and further preferably 50% or more. Note that the ratio of stitches facing the openings is calculated by a method for calculating the ratio of the number of stitches facing the openings of 0.3 mm or more and 2.5 mm or less to the total number of stitches of the composite yarn containing two or more different colored yarns in a predetermined area (for example, a 1 cm square) of an arbitrary portion of the front layer knitted fabric as viewed from the surface side.

Figure 3:
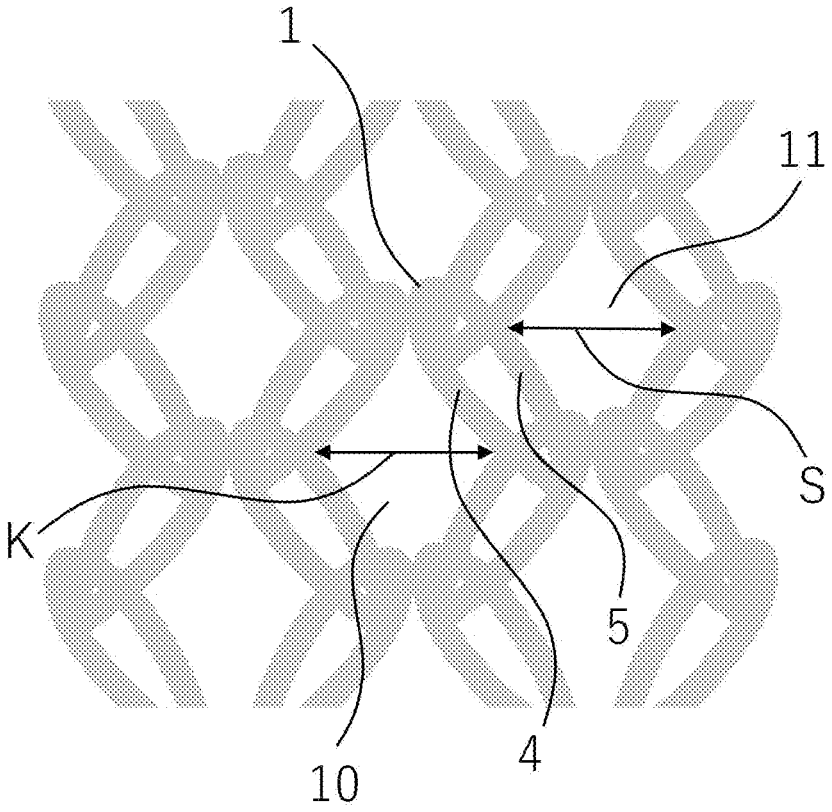
FIG. 3 is a schematic view of an example of the present embodiment, in which a stitch of a front layer knitted fabric formed of a composite yarn faces openings.

FIG. 3 is a schematic view showing a state in which an opening 10 of an opening size K (mm) and an opening 11 of an opening size S (mm) face one stitch 1 formed of the composite yarn containing two or more different colored yarns. These openings refer to the openings facing both left and right outsides of the two left and right pillars (4, 5) of the stitch 1, and the opening size refers to the length of a straight line connecting the two points having the longest straight distance on a horizontal line in the course direction (horizontal direction).

When stitches of the composite yarn containing two or more different colored yarns in the front layer knitted fabric face the openings, in order to impart a more three-dimensional appearance, it is more preferable that the back layer knitted fabric use a colored yarn, such as a black yarn, which is darker than the color of at least one of the colored yarns in the composite yarn of the front layer knitted fabric, since the color pattern of the composite yarn stands out due to the dark color of the back layer knitted fabric visible through the openings.

A preferably used method for making the openings facing the stitches formed of the composite yarn containing two or more different colored yarns in a front layer knitted fabric of the three-dimensional knitted material is a method in which an arbitrary portion of the front layer knitted fabric has a mesh structure or ridge structure, and the composite yarn is arranged in the positions of the openings of the mesh structure or ridge structure.

Any warp knitting structure can be used to make the front layer knitted fabric into a mesh structure or a ridge structure. In the case of a mesh structure, a yarn draw-out arrangement such as one-in-one-out or two-in-two-out is preferably used for the mesh structure when at least two reeds of a knitting machine are used to supply yarns from guide bars. In the case of a ridge structure, a preferable method is that a yarn draw-out arrangement such as one-in-one-out or two-in-two-out is used when at least two reeds of a knitting machine are used to supply yarns from guide bars, and sinker loops of a series of at least two or more stitch rows of the knitted fabric in the length direction (vertical direction) supplied from the two guide bars are appropriately pulled in opposite left and right directions by the movement of the two guide bars to bring the stitch rows together and create a convex ridge configuration.

The mesh structures or ridge structures in all courses of the knitted fabric are not necessarily the same mesh structure or ridge structure and may have a different knitting structure in some courses in combination.

In the openings formed in the front layer knitted fabric, it is preferable that a pattern yarn having an appearance different in color, form, gloss, etc., from at least one of the colored yarns of the composite yarn containing two or more different colored yarns forming the front layer knitted fabric be inlay knitted across the openings at an arbitrary angle in a substantially vertical direction, substantially horizontal direction, or substantially diagonal direction when viewed from the front side of the front layer knitted fabric, because designability with a greater sense of depth is exhibited.

Regarding the front layer knitted fabric of the three-dimensional knitted material of the present embodiment, in order to impart the front layer knitted fabric with a more natural heather and suppress the pulling out and fluffing of single fibers of the composite yarn containing two or more different colored yarns when the front layer knitted fabric is rubbed by a hard protrusion such as the hook of a hook-and-loop fastener, the fineness of the composite yarn, i.e., the total fineness of the two or more different colored yarns, is preferably 150 decitex or more and 800 decitex or less. Note that the single yarn fineness of the composite yarn is preferably 1 decitex or more and 6 decitex or less, and more preferably 3 decitex or more and 6 decitex or less, which increases the strength of the single yarns.

From the viewpoint of achieving a natural heather and suppressing the pulling out and fluffing of single fibers of the composite yarn, the knitting density of the front layer knitted fabric is preferably 20 courses/2.54 cm or more and 43 courses/2.54 cm or less and 18 wales/2.54 cm or more and 34 wales/2.54 cm or less, and the composite yarn more preferably has a total fineness of 200 decitex or more and 500 decitex or less, and a knitting density of 25 courses/2.54 cm or more and 43 courses/2.54 cm or less and 20 wales/2.54 cm or more and 30 wales/2.54 cm or less.

From the same viewpoint, the total fineness of one stitch of the front layer knitted fabric is preferably 150 decitex or more and 800 decitex or less. Note that the stitches formed of the composite yarn containing two or more different colored yarns need not be formed from only a single composite yarn, and a single stitch may be formed thereof in combination with another yarn.

The fiber used for the connecting yarn of the three-dimensional knitted material of the present embodiment is preferably a monofilament. When a monofilament is used as the connecting yarn, the fineness thereof is preferably 30 decitex or more and 300 decitex, and more preferably 50 decitex or more and 250 decitex, in order to suppress protrusion of the monofilament from the knitted fabric surface and maintain suitable cushioning properties.

If the monofilament protrudes from the surface of the knitted fabric of the three-dimensional knitted material, since it can easily get caught on protrusions such as the hook of a hook-and-loop fastener, it is desirable that the stitches of the fibers forming the front layer knitted fabric press down on the monofilament stitches so that the monofilament does not protrude from the front side of the front layer knitted fabric, and thus, it is preferable that the fineness D2 (decitex) of the monofilament relative to the total fineness D (decitex) of one stitch composed of the fibers forming the front layer knitted fabric satisfy the following relationship:

$$D/D2 \geq 3$$

In the three-dimensional knitted material of the present embodiment, any fibers can be used for the front layer knitted fabric, back layer knitted fabric, and connecting yarn, but from the viewpoint of gray yarn strength and light resistance, polyethylene terephthalate filament fibers are preferably used for the front layer knitted fabric and the back layer knitted fabric.

It is preferable that the front layer knitted fabric, back layer knitted fabric, and connecting yarn all be composed of 100% polyethylene terephthalate fibers in terms of ease of recycling such as material recycling and chemical recycling. Though these fibers may be undyed, it is preferable to use dope-dyed yarns or pre-dyed yarns in order to suppress variations in the properties of the three-dimensional knitted material during the dyeing process. Furthermore, it is more preferable to use a dope-dyed yarn mixed with a pigment or the like that can eliminate the need for a dyeing process.

The thickness of the three-dimensional knitted material of the present embodiment can be arbitrarily set, but from the viewpoint of sewing and handling properties as a covering material, it is preferably 2.5 mm or more and 12 mm or less, and more preferably 3 mm or more and 8 mm or less.

The basis weight of the three-dimensional knitted material constituting the covering material of the present embodiment can be arbitrarily set, but is preferably 300 to 1000 $g/m^2$, and more preferably 400 to 900 $g/m^2$.

In the finishing method of the three-dimensional knitted material of the present embodiment, in the case of a three-dimensional knitted material using pre-dyed yarns or dope-dyed yarns, though the gray fabric can be finished through processes such as scouring and heat setting, finishing by heat setting only is preferable in terms of process simplification. When any of the fibers used in the front layer knitted fabric, back layer knitted fabric, and connecting yarn of a three-dimensional knitted material is uncolored, the gray fabric can be finished through processes such as presetting, scouring, dyeing, and heat setting.

When the covering material of the present embodiment is used for vehicle seats, automobile interior materials, etc., though urethane can be laminated on the back side in the manner of conventional covering materials, it is preferable to use it without lamination in terms of recyclability.

EXAMPLES

The present invention will be more specifically described below by means of Examples and Comparative Examples, but the present invention is not limited to only the Examples.

The methods for measuring the various physical properties of the three-dimensional knitted material used in the Examples below were as follows.

(a) Angle (Degrees) Between Stitch Formed of Composite Yarn Containing Two or More Different Colored Yarns and Adjacent Stitch Using a one-shot 3D measurement microscope VR-3000 manufactured by Keyence Corporation, at a magnification of 40-fold, an arbitrary portion of the front side face of the front layer knitted fabric of the three-dimensional knitted material is photographed using autofocus and 3D measurement, with the knitting start direction facing toward forward (lower side of the image). From the captured 3D image, among the two pillars consisting of left and right fiber bundles of one stitch composed of the composite yarn containing two or more different colored yarns, in the pillar on one side including the part on the outermost surface side, a straight line connecting the lowest point where the pillar can be seen (the lowest point in the image) to the highest point where the pillar can be seen (the highest point in the image) is drawn. Note that if the heights on the outermost surface side of the two pillars are the same, the pillar which forms a larger angle with the adjacent stitch is selected. Furthermore, among the two pillars consisting of left and right fiber bundles of a stitch adjacent to the stitch of the composite yarn containing two or more different colored yarns in the course direction (horizontal direction) and wale direction (vertical direction), in the pillar on one side including the part on the outermost surface side, a straight line from the lowest point where the pillar can be seen (the lowest point in the image) to the highest point where the pillar can be seen (the highest point in the image) is drawn. The angle formed by the intersection of the two obtained straight lines in the portion open in the direction of the end of knitting is measured. Measurement is performed in both the course direction and the wale direction for all stitches formed of the composite yarn containing two or more different colored yarns within a certain area (0.7 cm square to 1 cm square) of the 3D image.

(b) Opening Size (mm)

From the 3D image captured in (a) above, in an opening facing the stitch formed of the composite yarn containing two or more different colored yarns, the length of the horizontal line in the course direction (horizontal direction) connecting the two points where the straight-line distance is the longest with a straight line is measured and defined as the opening size.

(c) Fineness of Composite Yarn (decitex)

The front layer knitted fabric of the three-dimensional knitted material is unraveled, a composite yarn of 10 cm or more is extracted, and the length and weight when a load of 15 gf is applied to one composite yarn is measured to calculate the fineness. Three composite yarn samples are extracted and the average value therebetween is determined. When the fineness can be measured before knitting the three-dimensional knitted material, measurement is performed in accordance with JIS L 1013.

(d) Heather Designability

The front layer knitted fabric of the three-dimensional knitted material is visually observed from the front side, and the following grading is performed to determine whether or not it has heather designability. Judgment is made in 0.5 grade increments.

Grade 5: Exhibits excellent natural heather
Grade 4: Exhibits good natural heather
Grade 3: Exhibits a somewhat natural heather
Grade 2: Exhibits substantially no natural heather
Grade 1: Does not exhibit any natural heather at all (e) Three-Dimensional Heather Designability The front layer knitted fabric of the three-dimensional knitted material is visually observed from the front side, and the following grading is performed to determine whether or not the heather pattern has a deep three-dimensional effect. Judgment is made in 0.5 grade increments.

Grade 5: Excellent sense of depth
Grade 4: Considerable sense of depth
Grade 3: Some sense of depth
Grade 2: Substantially no sense of depth
Grade 1: No sense of depth at all (f) Diagonal Marbling Heather Designability The front layer knitted fabric of the three-dimensional knitted material is visually observed from the front side, and the following grading is performed to determine whether or not the heather pattern flows diagonally. Judgment is made in 0.5 grade increments.

Grade 5: Exhibits an excellent heather that flows diagonally
Grade 4: Exhibits a considerable heather that flows diagonally
Grade 3: Exhibits a slight heather that flows diagonally
Grade 2: Exhibits substantially no heather that flows diagonally
Grade 1: Exhibits no heather that flows diagonally

Example 1

In a double raschel knitting machine having 6 reeds of 22-gauge with a trick plate distance of 6 mm, composite yarns of a false twist yarn (black dope-dyed yarn) of 167 decitex 48 filament polyethylene terephthalate fibers and a false twist yarn (white yarn) of 167 decitex 48 filament polyethylene terephthalate fibers aligned together and twisted at a twist count of 120 turns/m were supplied from two reeds (L1, L2) in one-in-one-out (L1) and one-out-one-in (L2) arrangements for forming a front layer knitted fabric, a monofilament of a polyethylene terephthalate fiber (black dope-dyed yarn) of 110 decitex was supplied in a one-in-one-out arrangement from one reed (L3) for forming a connecting part, and false twist yarns (black dope-dyed yarn) of 167 dtex 48 filament polyethylene terephthalate fibers were supplied from two reeds (L4, L5) both in an all-in arrangement for forming the back layer knitted fabric.

A gray fabric composed of the three-dimensional knitted material was knitted with the knitting structure shown below, with a machine course of 35 courses/2.54 cm. The obtained gray fabric was drying-heat set at 175° C. for 1 minute with a tentering rate of 0% and an overfeed rate of 0% to obtain a three-dimensional knitted material having physical properties shown in Table 1 below, and this was used as a covering material.

(Knitting Structure)

L1: 1011/2322/(one-in-one-out)
L2: 2322/1011/(one-out-one-in)
L3: 3410/4367/(one-in-one-out)
L4: 1110/0001/(all-in)
L5: 2210/2234/(all-in)

Example 2

A gray fabric composed of a three-dimensional knitted material was knitted in the same manner as in Example 1, except that the knitting structure shown below was used. The obtained gray fabric was heat set in the same manner as in Example 1 to obtain a three-dimensional knitted material having physical properties shown in Table 1 below, and this was used as a covering material.

(Knitting Structure)

L1: 1011/1233/4544/4322/(one-in-one-out)
L2: 4544/4322/1011/1233/(one-out-one-in)
L3: 3410/3245/2145/2310/(one-in-one-out)
L4: 1110/0001/(all-in)
L5: 2210/2234/(all-in)

Example 3

A gray fabric composed of a three-dimensional knitted material was knitted in the same manner as in Example 1, except that the knitting structure shown below was used. The obtained gray fabric was heat set in the same manner as in Example 1 to obtain a three-dimensional knitted material having physical properties shown in Table 1 below, and this was used as a covering material.

(Knitting Structure)

L1: (1011/2322/)×3(1011/1211/)×3(one-in-one-out)
L2: (2322/1011/)×3(3233/3433/)×3(one-out-one-in)
L3: (3410/4367/)×3(4367/3410/)×3(one-in-one-out)
L4: 1110/0001/(all-in)
L5: 2210/2234/(all-in)

Example 4

A gray fabric composed of a three-dimensional knitted material was knitted in the same manner as in Example 1, except that the knitting structure shown below was used. The obtained gray fabric was heat set in the same manner as in Example 1 to obtain a three-dimensional knitted material having physical properties shown in Table 1 below, and this was used as a covering material.

(Knitting Structure)

L1: 1011/1211/(one-in-one-out)
L2: 1011/1211/(one-out-one-in)
L3: 4367/3410/(one-in-one-out)
L4: 0001/1110/(all-in)
L5: 2234/2210/(all-in)

Examples 5 to 71

In a double raschel knitting machine having 6 reeds of 22-gauge with a trick plate distance of 6 mm, gray fabrics composed of three-dimensional knitted materials having different composite yarn blending ratios were knitted in the same manner as in Example 1, except that two composite yarns and one 334 decitex 72 filament false twist yarn in this order (Example 5), one composite yarn and one 334 decitex 72 filament false twist yarn in this order (Example 6), and one composite yarn and two 334 decitex 72 filament false twist yarns in this order (Example 7) were supplied from two reeds (L1, L2) in one-in-one-out (L1) and one-out-one-in (L2) arrangements relative to the guide for forming a front layer knitted fabric, wherein the composite yarn was a false twist yarn (black dope-dyed yarn) of 167 decitex 48 filament polyethylene terephthalate fibers and a false twist yarn (white yarn) of 167 decitex 48 filament polyethylene terephthalate fibers aligned together and twisted at a twist count of 120 turns/m and the false twist yarn was composed of 334 decitex 72 filament polyethylene terephthalate fibers (black dope-dyed yarn). The obtained gray fabrics were drying-heat set in the same manner as in Example 1 to obtain three-dimensional knitted materials having physical properties shown in Tables 1 and 2 below, and these were used as covering materials.

Comparative Example 1

A gray fabric composed of a three-dimensional knitted material was knitted in the same manner as Example 1, except that a false twist yarn (black dope-dyed yarn) of 334 decitex 72 filament polyethylene terephthalate fibers from one reed (L1) in a one-in-one-out arrangement and a false twist yarn (white) of 334 decitex 72 filament polyethylene terephthalate fibers from the other reed (L2) in a one-out-one-in arrangement were supplied for forming a front layer knitted fabric. The obtained gray fabric was heat set in the same manner as in Example 1 to obtain a three-dimensional knitted material having physical properties shown in Table 2 below, and this was used as a covering material.

Comparative Example 2

In a double raschel knitting machine having 6 reeds of 18-gauge with a trick plate distance of 6 mm, composite yarns of a false twist yarn (black dope-dyed yarn) of 167 decitex 48 filament polyethylene terephthalate fibers and a false twist yarn (white yarn) of 167 decitex 48 filament polyethylene terephthalate fibers aligned together and interlace-blended were supplied from two reeds (L1, L2) each in an all-in arrangement for forming a front layer knitted fabric, a monofilament of a polyethylene terephthalate fiber (black dope-dyed yarn) of 200 decitex was supplied in a one-in-one-out arrangement from one reed (L3) for forming a connecting part, and false twist yarns of 167 decitex and 48 filament polyethylene terephthalate fibers (black dope-dyed yarns) were supplied in an all-in arrangement from two reeds (L4, L5) for forming a back layer knitted fabric.

A gray fabric composed of a three-dimensional knitted material was knitted with the knitting structure shown below, with a machine course of 16 courses/2.54 cm. The obtained gray fabric was beat set in the same manner as in Example 1 to obtain a three-dimensional knitted material having the physical properties shown in Table 2 below, and this was used as a covering material.

(Knitting Structure)

L1: 1011/2322/(all in)

L2: 2322/1011/(all in)

L3: 3410/4367/(one-in-one-out)

L4: 1110/0001/(all-in)

L5: 2210/2234/(all-in)

TABLE 1

| | | Ex 1 | Ex 2 | Ex 3 | Ex 4 | Ex 5 |
|---|---|---|---|---|---|---|
| Yarns used | Front layer knitted fabric (composite yarn) | Twisted yarn of PET167/48 black dope-dyed false twist yarn × PET167/48 false twist yarn (white) | Twisted yarn of PET167/48 black dope-dyed false twist yarn × PET167/48 false twist yarn (white) | Twisted yarn of PET167/48 black dope-dyed false twist yarn × PET167/48 false twist yarn (white) | Twisted yarn of PET167/48 black dope-dyed false twist yarn × PET167/48 false twist yarn (white) | Twisted yarn of PET167/48 black dope-dyed false twist yarn × PET167/48 false twist yarn (white) |
| | Front layer knitted fabric (other than composite yarn) | — | — | — | — | PET334/72 black dope-dyed false twist yarn |
| | Connecting yarn | PET110 | PET110 | PET110 | PET110 | PET110 |
| | Back layer knitted fabric | PET167/48 black dope-dyed false twist yarn | PET167/48 black dope-dyed false twist yarn | PET167/48 black dope-dyed false twist yarn | PET167/48 black dope-dyed false twist yarn | PET167/48 black dope-dyed false twist yarn |
| Composite yarn fineness (decitex) | | 361 | 361 | 361 | 361 | 357 |
| Thickness (mm) | | 5.9 | 5.9 | 5.9 | 5.9 | 5.8 |
| Knitting density | Course number/2.54 cm | 36.5 | 36.5 | 36.3 | 36.1 | 36.5 |
| | Wale number/2.54 cm | 23.2 | 23.2 | 23.2 | 23.0 | 23.2 |
| Basis weight ($g/m^2$) | | 623 | 631 | 614 | 605 | 608 |
| Ratio of stitches formed of composite yarn of two or more different colored yarns to stitches included in front layer knitted fabric (%) | | 100 | 100 | 100 | 100 | 67 |
| Ratio of stitches facing openings of 0.3 mm or more and 2.5 mm or less to stitches formed of composite yarn (%) | | 100 | 50 | 33 | 0 | 100 |
| Ratio of stitches formed of composite yarn forming angle of 20 degrees or more and 80 degrees or less with adjacent stitches (%) | | 100 | 33 | 50 | 100 | 100 |
| Heather designability (grade) | | 5.0 | 4.0 | 4.5 | 5.0 | 4.5 |
| Three-dimensional heather designability (grade) | | 4.5 | 4.0 | 3.5 | 1.5 | 3.5 |
| Diagonal marbling heather designability (grade) | | 5.0 | 4.0 | 4.5 | 5.0 | 4.5 |

TABLE 2

| | | Ex 6 | Ex 7 | Comp Ex 1 | Comp Ex 2 |
|---|---|---|---|---|---|
| Yarns used | Front layer knitted fabric (composite yarn) | Twisted yarn of PET167/48 black dope-dyed false twist yarn × PET167/48 false twist yarn (white) | Twisted yarn of PET167/48 black dope-dyed false twist yarn × PET167/48 false twist yarn (white) | — | Interlaced blended yarn of PET167/48 black dope-dyed false twist yarn × PET167/48 false twist yarn (white) |
| | Front layer knitted fabric (other than composite yarn) | PET334/72 black dope-dyed false twist yarn | PET334/72 black dope-dyed false twist yarn | Single alternating PET334/72 black dope-dyed false twist yarn × PET334/72 false twist yarn (white) | — |
| | Connecting yarn | PET110 | PET110 | PET110 | PET200 |
| | Back layer knitted fabric | PET167/48 black dope-dyed false twist yarn | PET167/48 black dope-dyed false twist yarn | PET167/48 black dope-dyed false twist yarn | PET167/48 black dope-dyed false twist yarn |
| Composite yarn fineness (decitex) | | 352 | 350 | 345 | 352 |
| Thickness (mm) | | 5.8 | 5.8 | 5.8 | 5.7 |
| Knitting density | Course number/2.54 cm | 36.5 | 36.5 | 36.5 | 18.2 |
| | Wale number/2.54 cm | 23.2 | 23.2 | 23.2 | 20.5 |
| Basis weight (g/m$^2$) | | 601 | 597 | 580 | 621 |
| Ratio of stitches formed of composite yarn of two or more different colored yarns to stitches included in front layer knitted fabric (%) | | 50 | 33 | 0 | 100 |
| Ratio of stitches facing openings of 0.3 mm or more and 2.5 mm or less to stitches formed of composite yarn (%) | | 100 | 100 | 100 | 0 |
| Ratio of stitches formed of composite yarn forming angle of 20 degrees or more and 80 degrees or less with adjacent stitches (%) | | 100 | 100 | 100 | 26 |
| Heather designability (grade) | | 4.0 | 3.5 | 1.5 | 2.5 |
| Three-dimensional heather designability (grade) | | 3.5 | 3.5 | 1.5 | 1.5 |
| Diagonal marbling heather designability (grade) | | 4.0 | 3.5 | 1.0 | 2.0 |

As shown in Tables 1 and 2, it was found that the covering materials composed of the three-dimensional knitted materials of Examples 1 to 7, in which 30% or more of the stitches included in the front layer knitted fabric contained the composite yarn of two different colored yarns, exhibited high natural heather designability relative to Comparative Example 1, in which the front layer knitted fabric did not contain a composite yarn of two different colored yarns, and in which stitches of different colors composed of two different colored yarns supplied from different reeds were arranged alternatingly, and Comparative Example 2, in which the ratio of the stitches wherein the angle between a stitch formed of the composite yarn of two different colors and an adjacent stitch was 20 degrees or more and 80 degrees or less of the composite yarn was less than 30%.

Comparing Examples 1, 5, 6, and 7 in terms of the ratio of the stitches of the composite yarn of two different colored yarns in the front layer knitted fabric, it was found that the natural heather designability increased as the blending ratio increased.

Comparing Examples 1, 2, and 3, which were different in the ratio of the stitches of the composite yarn where the angle between each of the stitches formed of the composite yarns of two different colors and an adjacent stitch was 20 degrees or more and 80 degrees or less, it was found that the higher the ratio, the higher the diagonal marbling heather designability.

Comparing Examples 1, 2, and 3, which were different in the ratio of the stitches of the composite yarn of two different colors facing the openings having an opening size of 0.3 mm or more and 2.5 mm or less, it was found that the higher the ratio of the stitches facing the opening, the greater the three-dimensional heather designability.

INDUSTRIAL APPLICABILITY

The covering material of the present invention can be placed on cushion members such as urethane pads for seats of vehicles and furniture, and can be used in seats formed of stretching onto seat frames, and in interior materials such as vehicle ceilings and door trims, and since the front layer knitted fabric is composed of a composite yarn containing two or more different colored yarns, it can suitably be adopted as a covering material with a heather and a high degree of designability.

DESCRIPTION OF REFERENCE SIGNS

1 one stitch formed of composite yarn containing two or more different colored yarns
2 adjacent stitches in the course direction
3 adjacent stitches in the wale direction
4 pillar consisting of fiber bundle
5 pillar consisting of fiber bundle
6 pillar consisting of fiber bundle
7 pillar consisting of fiber bundle
8 pillar consisting of fiber bundle
9 pillar consisting of fiber bundle
10 opening
11 opening
L1 straight line connecting lowest point and highest point where pillar can be seen
L2 straight line connecting lowest point and highest point where pillar can be seen
L3 straight line connecting lowest point and highest point where pillar can be seen
K opening size S opening size X angle of stitch formed of composite yarn containing two or more different colored yarns and adjacent stitch Y angle of stitch formed of composite yarn containing two or more different colored yarns and adjacent stitch a lowest point where pillar can be seen b highest point where pillar can be seen c lowest point where pillar can be seen d highest point where pillar can be seen e lowest point where pillar can be seen f highest point where pillar can be seen

The invention claimed is:

1. A covering material, comprising a three-dimensional knitted material constituted by a front layer knitted fabric, a back layer knitted fabric, and a connecting yarn which connects the front layer knitted fabric and the back layer knitted fabric, wherein 30% or more of stitches included in the front layer knitted fabric are formed of a composite yarn containing two or more different colored yarns, and 30% or more of the stitches formed of the composite yarn each form an angle of 20 degrees or more and 80 degrees or less with a stitch adjacent thereto in a course direction and/or a wale direction.

2. The covering material according to claim 1, wherein 50% or more of stitches included in the front layer knitted fabric are formed of a composite yarn containing two or more different colored yarns.

3. The covering material according to claim 2, wherein 60% or more of stitches included in the front layer knitted fabric are formed of a composite yarn containing two or more different colored yarns.

4. The covering material according to claim 1, wherein 50% or more of the stitches formed of the composite yarn each have an angle of 20 degrees or more and 80 degrees or less with a stitch adjacent thereto in the course direction and/or the wale direction.

5. The covering material according to claim 1, wherein the three-dimensional knitted material has openings of 0.3 mm or more and 2.5 mm or less, and 30% or more of the stitches formed of the composite yarn face the openings of 0.3 mm or more and 2.5 mm or less.

6. The covering material according to claim 5, wherein 50% or more of the stitches formed of the composite yarn face the openings of 0.3 mm or more and 2.5 mm or less.

7. The covering material according to claim 5, wherein the back layer knitted fabric contains a yarn which is darker than at least one of the colored yarns of the composite yarn of the front layer knitted fabric.

8. The covering material according to claim 1, wherein 30% or more of the stitches formed of the composite yarn are each adjacent in the course direction and/or wale direction to a stitch formed of a colored yarn different from at least one of the colored yarns of the composite yarn.

9. The covering material according to claim 1, wherein in the front layer knitted fabric, a fineness of the composite yarn is 150 decitex or more and 800 decitex or less.

10. The covering material according to claim 1, wherein a knitting density of the front layer knitted fabric is 20 courses/2.54 cm or more and 43 courses/2.54 cm or less and 18 wales/2.54 cm or more and 34 wales/2.54 cm or less.

11. The covering material according to claim 2, wherein the three-dimensional knitted material has openings of 0.3 mm or more and 2.5 mm or less, and 30% or more of the stitches formed of the composite yarn face the openings of 0.3 mm or more and 2.5 mm or less.

12. The covering material according to claim 3, wherein the three-dimensional knitted material has openings of 0.3 mm or more and 2.5 mm or less, and 30% or more of the stitches formed of the composite yarn face the openings of 0.3 mm or more and 2.5 mm or less.

13. The covering material according to claim 4, wherein the three-dimensional knitted material has openings of 0.3 mm or more and 2.5 mm or less, and 30% or more of the stitches formed of the composite yarn face the openings of 0.3 mm or more and 2.5 mm or less.

14. The covering material according to claim 5, wherein 30% or more of the stitches formed of the composite yarn are each adjacent in the course direction and/or wale direction to a stitch formed of a colored yarn different from at least one of the colored yarns of the composite yarn.

15. The covering material according to claim 5, wherein in the front layer knitted fabric, a fineness of the composite yarn is 150 decitex or more and 800 decitex or less.

16. The covering material according to claim 5, wherein a knitting density of the front layer knitted fabric is 20 courses/2.54 cm or more and 43 courses/2.54 cm or less and 18 wales/2.54 cm or more and 34 wales/2.54 cm or less.

17. The covering material according to claim 1, wherein the three-dimensional knitted material has openings of 0.3 mm or more and 2.5 mm or less, and 40% or more of the stitches formed of the composite yarn face the openings of 0.3 mm or more and 2.5 mm or less.

18. The covering material according to claim 1, wherein the three-dimensional knitted material has openings of 0.3 mm or more and 2.5 mm or less, and 50% or more of the stitches formed of the composite yarn face the openings of 0.3 mm or more and 2.5 mm or less.

* * * * *